US006182838B1

(12) United States Patent
Hodson

(10) Patent No.: US 6,182,838 B1
(45) Date of Patent: Feb. 6, 2001

(54) POOLSIDE ORGANIZER

(76) Inventor: Della M. Hodson, 3760 NE. 92nd Pl., Anthony, FL (US) 32617

( * ) Notice: Under 35 U.S.C. 154(b), the term of this patent shall be extended for 0 days.

(21) Appl. No.: 09/416,443

(22) Filed: Oct. 12, 1999

(51) Int. Cl.[7] ..... A47F 7/00
(52) U.S. Cl. ..... 211/70.6
(58) Field of Search ..... 211/70.6, 10, 71.01, 211/72, 85.17, 85.7

(56) References Cited

U.S. PATENT DOCUMENTS

| | | | | |
|---|---|---|---|---|
| D. 253,638 | | 12/1979 | Killingsworth | D12/34 |
| 2,059,445 | * | 11/1936 | Eastman | 211/70.6 |
| 3,887,103 | | 6/1975 | Spooner | 220/20 |
| 5,048,902 | | 9/1991 | Daly | 312/250 |
| 5,207,723 | | 5/1993 | Newby, Sr. | 312/249 |
| 5,249,857 | | 10/1993 | Suzuki | 312/263 |
| 5,626,307 | | 5/1997 | Smith | 242/403.1 |
| 5,704,496 | * | 1/1998 | Latta | 211/70.6 |
| 5,765,699 | | 6/1998 | Griffin | 211/70.6 |
| 5,833,334 | | 11/1998 | Harper | 312/257 |

* cited by examiner

*Primary Examiner*—Alvin Chin-Shue
*Assistant Examiner*—Sarah Purol
(74) *Attorney, Agent, or Firm*—Edward M. Livingston, Esq.

(57) ABSTRACT

A poolside organizer has build-up structure with quick-and-easy assembly of a base enclosure (11) and a top enclosure (23) having upright support from the base enclosure. A front hanger wall (17) supports a plurality of hangers (25) for holding swimming attire and other items. A left upright (1) supports a plurality of tube hangers (24). A right upright (6) supports a plurality of the swimming-attire hangers in addition to one or more optional boxlike poolside trays (26). An extension closure (29) contains un-hangable poolside items loosely or in baskets.

22 Claims, 4 Drawing Sheets

POOLSIDE ORGANIZER

BACKGROUND OF THE INVENTION

This invention relates to containers and hangers for poolside containment and organizing of swimming pool items.

Increasing use of residential swimming pools has created a need for organized containment of items used frequently for swimming, playing and relaxing in and around them. There are known containers that could be used to contain items at a poolside, but none having the quick assembly, convenience, and organizational advantages specifically for poolside items in a manner made possible with this invention.

Examples of the most closely related but different known organizers are described in the following patent documents. U.S. Pat. No. 5,833,334, issued to Harper on Nov. 10, 1998, described a home-entertainment organizer for TV-related items that would not be suitable for poolside items. U.S. Pat. No. 5,765,699, issued to Griffin on Jun. 16, 1998, described a holder of swimming-pool maintenance equipment in a garage or other building. U.S. Pat. No. 5,626,307, issued to Smith on May 6, 1997, described mobile holder of swimming-pool maintenance equipment. U.S. Pat. No. 5,249,857, issued to Suzuki on Oct, 5, 1993, described build-up furniture for homes. U.S. Pat. No. 3,887,103, issued to Spooner on Jun. 3, 1975, described a hand-tool box for carrying pool-maintenance tools.

SUMMARY OF THE INVENTION

Objects of patentable novelty and utility taught by this invention are to provide a poolside organizer which:

- holds such poolside items as floats, fins, snorkels, lotion, bathing suits, towels, toys, boogie boards, swim rings, sun glasses and hats with convenient organization and easy accessibility;
- can be packaged compactly unassembled for marketing;
- can be assembled quickly and easily;
- is sturdy for withstanding poolside uses and movement; and
- can be structured and designed attractively.

This invention accomplishes these and other objectives with a poolside organizer having (a) a base with storage dividers and quick-assembly joints for upright structure, (b) a front wall supporting a plurality of hangers and one or more optional boxlike containers, (c) a rear wall supporting a plurality of hangers and one or more optional boxlike containers, (d) a left upright supporting a plurality of hangers and one or more optional boxlike containers, (e) a right upright supporting a plurality of hangers and one or more optional boxlike containers, and (f) one or more bottom end enclosures for containing items loose or in baskets. Quick-assemble and quick-disassemble fastener joints are provided for build-up structure.

The above and other objects, features and advantages of the present invention should become even more readily apparent to those skilled in the art upon a reading of the following detailed description in conjunction with the drawings wherein there is shown and described illustrative embodiments of the invention.

BRIEF DESCRIPTION OF DRAWINGS

This invention is described by appended claims in relation to description of a preferred embodiment with reference to the following drawings which are explained briefly as follows:

DESCRIPTION OF PREFERRED EMBODIMENT

Figure 1:
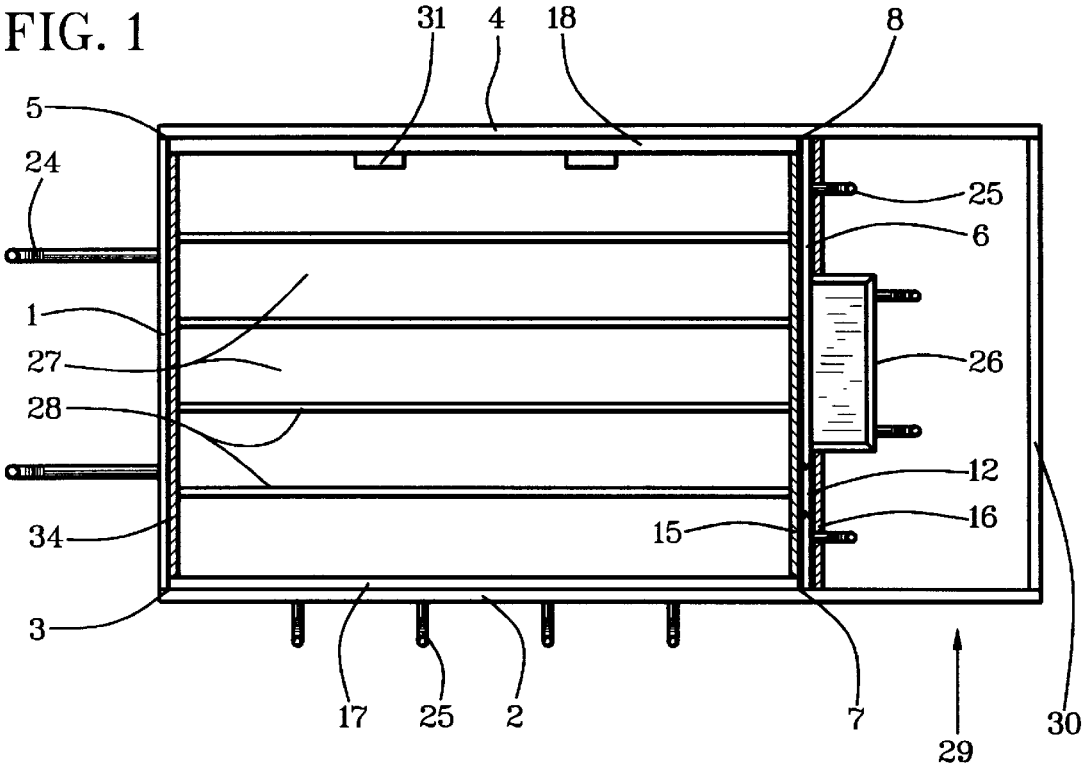
FIG. 1 is a top view of a poolside organizer with an extension enclosure and having an upright receptacle.
Figure 2:
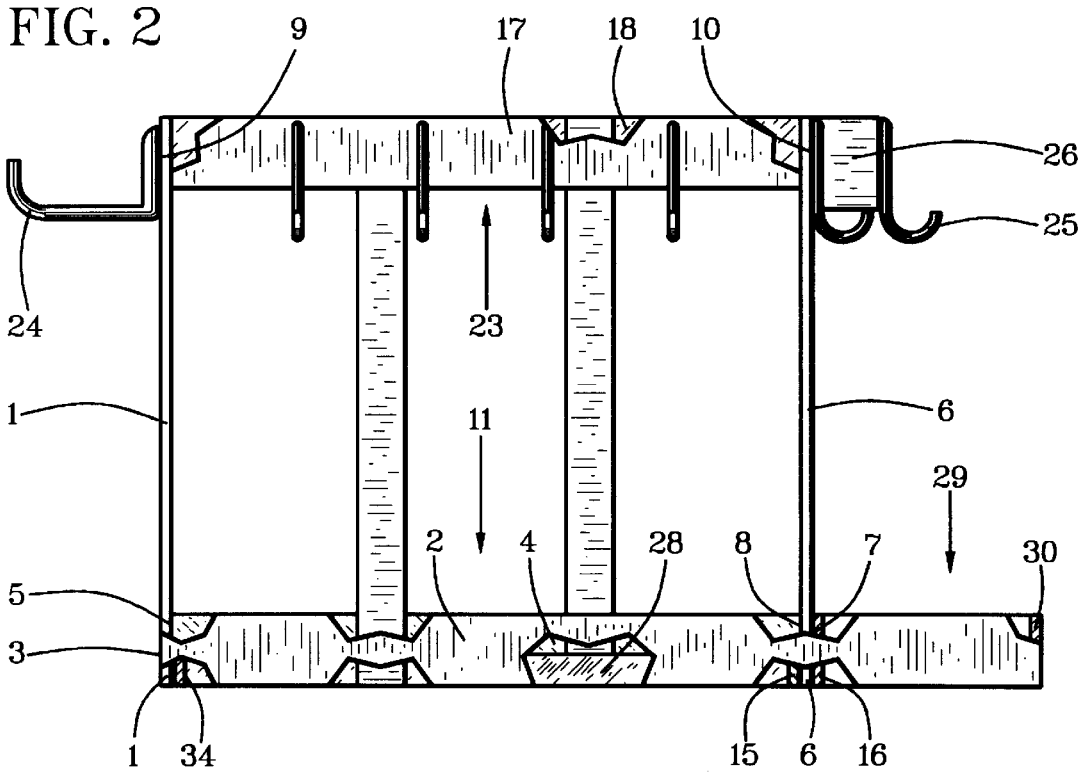
FIG. 2 is a partially cutaway front view of the FIG. 1 illustration.
Figure 3:
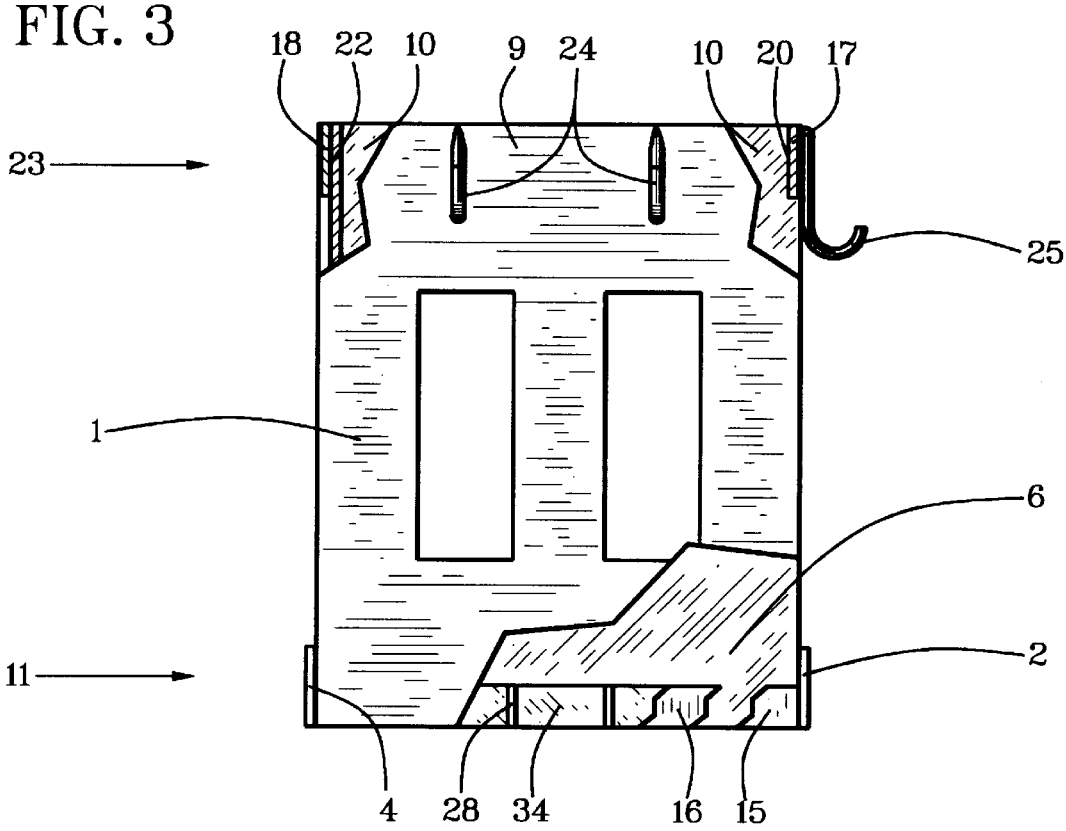
FIG. 3 is a partially cutaway left-side view of the FIG. 1 illustration.
Figure 4:
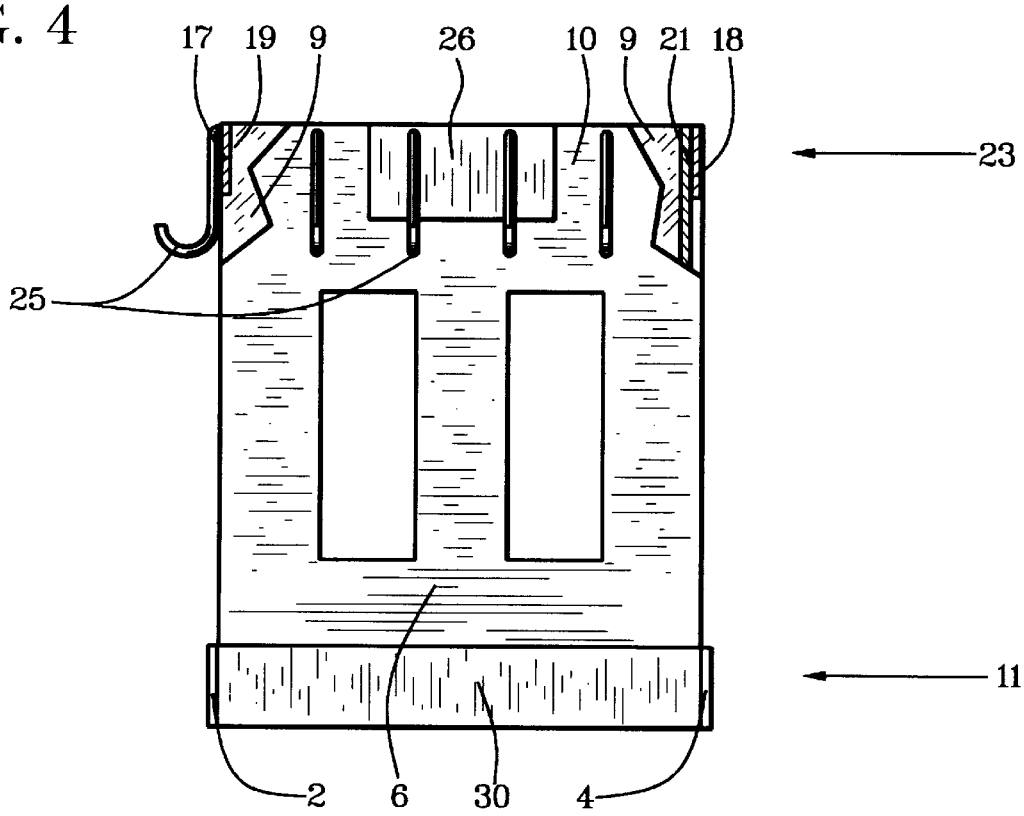
FIG. 4 is a partially cutaway right-side view of the FIG. 1 illustration.

Listed numerically below with reference to the drawings are terms used to describe features of this invention. These terms and list numbers assigned to them designate the same features throughout this description.

| | |
|---|---|
| 1. Left upright | 18. Rear hanger wall |
| 2. Front bottom wall | 19. Front-left hanger joint |
| 3. Left-front upright joint | 20. Front-right hanger joint |
| 4. Rear bottom wall | 21. Rear-left hanger joint |
| 5. Left-rear upright joint | 22. Rear-right hanger joint |
| 6. Right upright | 23. Top enclosure |
| 7. Right-front upright joint | 24. Tube hangers |
| 8. Right-rear upright joint | 25. Swimming-attire hangers |
| 9. Left hanger wall | 26. Poolside tray |
| 10. Right hanger wall | 27. Linear slots |
| 11. Base enclosure | 28. Slot walls |
| 12. Upright receptacle | 29. Extension enclosure |
| 13. Angle bracket | 30. Extension wall |
| 14. Overlap bracket | 31. Rear-wall struts |
| 15. Left receptacle wall | 32. Fastener orifices |
| 16. Right receptacle wall | 33. Fasteners |
| 17. Front hanger wall | 34. Left-upright support |

Reference is made first to FIGS. 1–5. A left upright 1 has a bottom end that is joined to a front bottom wall 2 proximate a left-front upright joint 3 and that is joined to a rear bottom wall 4 proximate a left-rear upright joint 5. A right upright 6 has a bottom end that is joined to the front bottom wall 2 proximate a right-front upright joint 7 and that is joined to the rear bottom wall 4 proximate a right-rear upright joint 8. The left upright 1 has a top end with a left hanger wall 9 and the right upright 6 has a top end with a right hanger wall 10.

The front bottom wall 2, the rear bottom wall 4, the bottom end of the left upright 1 and the bottom end of the right upright 6 are a base enclosure 11 having a length, a width and a breadth to enclose bottom ends of a predetermined volume of elongate poolside items in variously upright orientations.

Figure 6:
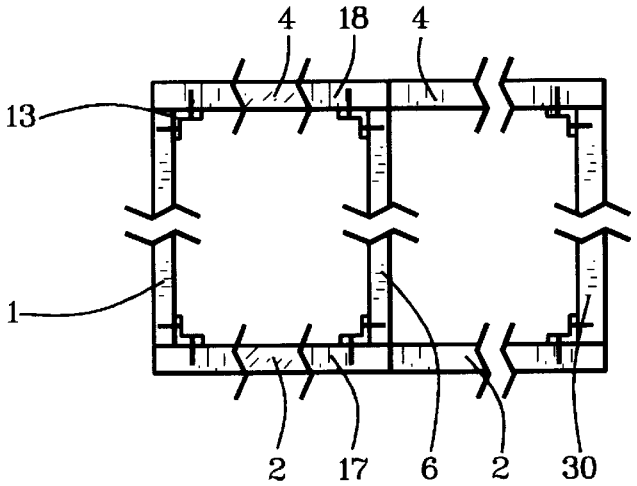
FIG. 6 is an expanded top view of corners of a poolside organizer having angle fasteners for being joined together.
Figure 7:
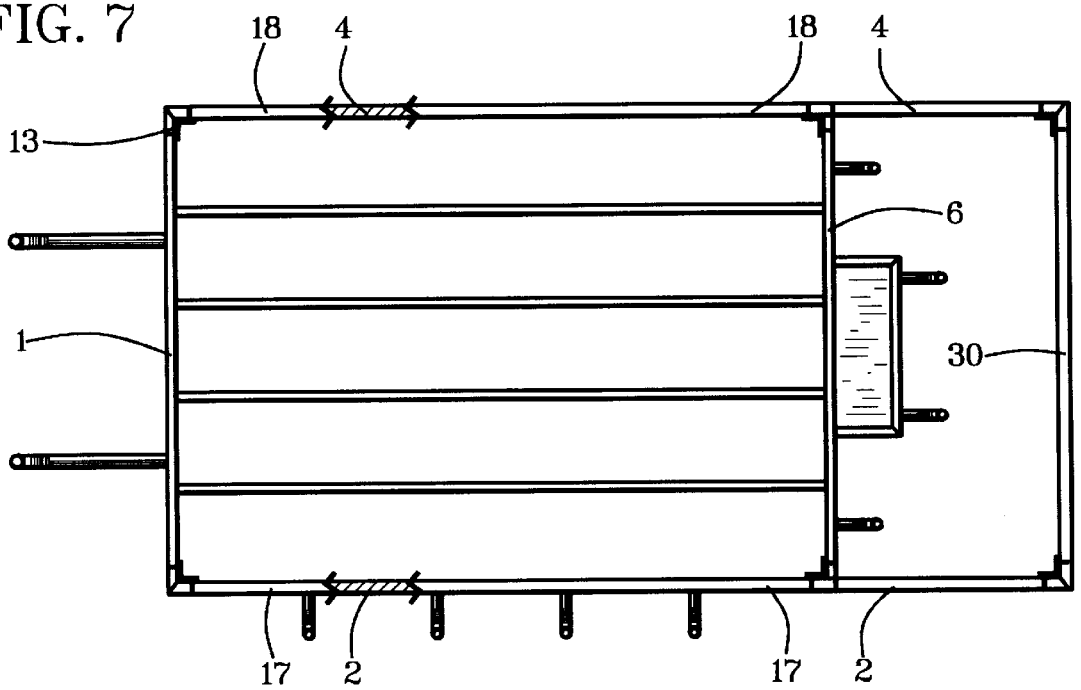
FIG. 7 is a top view of a poolside organizer joined together with angle fasteners.
Figure 8:
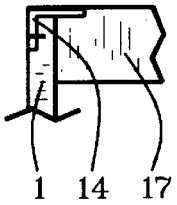
FIG. 8 is an expanded side view of an embedded overlap fastener on a corner of a poolside organizer.
Figure 9:
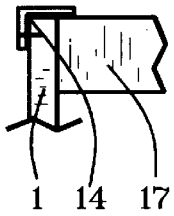
FIG. 9 is an expanded side view of a non-embedded overlap fastener on a corner of a poolside organizer.
Figure 10:
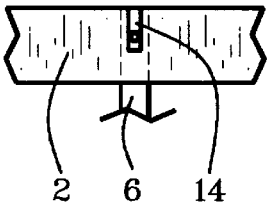
FIG. 10 is an expanded side view of an embedded overlap fastener on a side wall of a poolside organizer.
Figure 11:
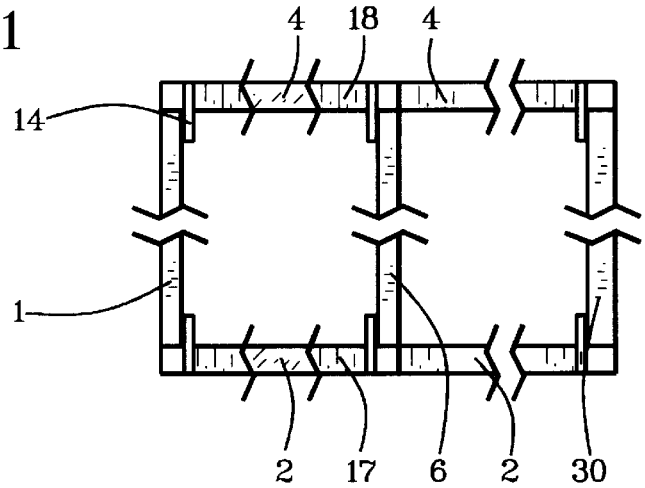
FIG. 11 is an expanded top view of corners of a poolside organizer joined together with overlap fasteners.
Figure 12:
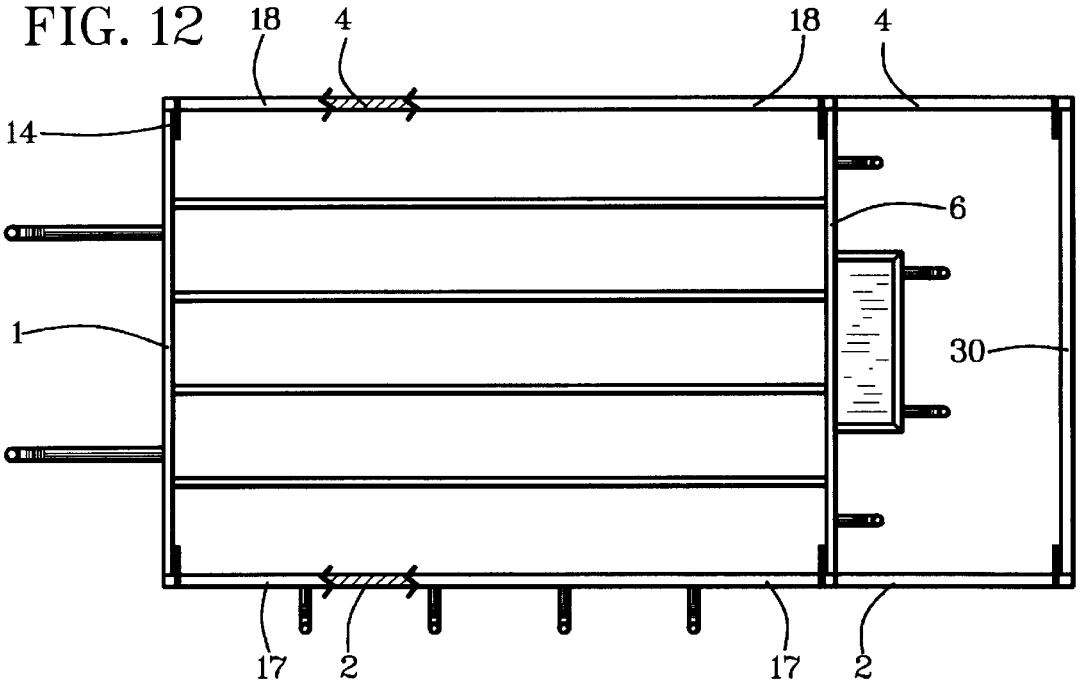
FIG. 12 is a top view of a poolside organizer joined together with overlap fasteners.

The left upright 1 and the right upright 6 are supported in a vertically upright orientation by at least one upright support such as an upright receptacle 12 as shown in FIGS. 1–4, at least one angle bracket 13 as shown in FIGS. 6–7 or at least one overlap bracket 14 as shown in FIGS. 8–12. The upright receptacle 12 provides upright support by rigid attachment of a left receptacle wall 15 and a right receptacle wall 16 to the front bottom wall 2 and to the rear bottom wall 4. The right upright 6 positioned in the upright receptacle 12 between them provides upright rigidity to other structural elements attached directly or indirectly to the right upright 6. Attachment of the left upright 1 and/or the right upright 6 to the front bottom wall 2 and to the rear bottom wall 4 with fastener members and fastener brackets such as the angle brackets 13 and the overlap brackets 14 provides upright support also, but with different requirement for fasteners in contrast to a drop-in method of build-up assembly.

At the front, a front hanger wall 17 has a left end that is joined to a top of the left upright 1 and has a right end that is joined to a top of the right upright 6. Similarly at the rear, a rear hanger wall 18 has a left end that is joined to a top of the left upright 1 and has a right end that is joined to a top of the right upright 6.

The front hanger wall 17 and the left hanger wall 9 have a front-left hanger joint 19. The front hanger wall 17 and the right hanger wall 10 have a front-right hanger joint 20. The rear hanger wall 18 and the left hanger wall 9 have a rear-left hanger joint 21. The rear hanger wall 18 and the right hanger wall 10 have a rear-right hanger joint 22. The front hanger wall 17, the rear hanger wall 18, the left hanger wall 9 and the right hanger wall 10 are a top enclosure 23 against which top portions of the elongate poolside items can lean.

A plurality of predetermined poolside hangers are positioned on the front hanger wall 17, the rear hanger wall 18, the left hanger wall 9 and the right hanger wall 10 selectively. Preferably for most uses, there are no poolside hangers positioned on the rear hanger wall 18 in order for one side to be free of hangers or other protrusions for positioning against a poolside fence or other structure. The poolside hangers are preferably two tube hangers 24 on the left hanger wall 9, four swimming-attire hangers 25 on the right hanger wall 10 and four swimming-attire hangers 25 on the front hanger wall 17 respectively. Preferably, the tube hangers 24 extend outwardly about ten-to-twelve inches and the swimming-attire hangers 25 extend out approximately three-to-six inches.

A poolside tray 26, preferably having a fluid-outlet bottom, is positioned preferably on only the right hanger wall 10, but can be positioned also on the front hanger wall 17, the rear hanger wall 18 and/or the left hanger wall 9 selectively. The poolside tray 26 is sized and shaped for holding suntan lotion, hair-care items, eye-care items and other body-care items. It is preferably three-to-five inches wide, three-to-five inches deep and about ten-to-fifteen inches long.

At least one bottom-end enclosure is positioned in the base enclosure 11 for arresting lateral travel of bottom ends of elongate poolside items positioned uprightly within the top enclosure 23. The bottom end enclosure is preferably a plurality of linear slots 27 that are juxtaposed intermediate the front bottom wall 2 and the rear bottom wall 4. Preferably, slot walls 28 of the linear slots 27 are lower than the front bottom wall 2 and the rear bottom wall 4, which are preferably about six inches high.

Preferably, at least one extension enclosure 29 is extended horizontally from at least one bottom end wall, preferably from the right upright 6 at the base enclosure 11. The extension enclosure 29 has an extension wall 30 between the front bottom wall 2 and the rear bottom wall 4. The extension enclosure 29 is sized and shaped to contain poolside items such as poolside toys, poolside items that are not easily hangable on the poolside hangers and optionally baskets for containing same.

Optionally, rear-wall struts 31 can be extended for vertical support between the rear bottom wall 4 and the rear hanger wall 18.

Figure 5:
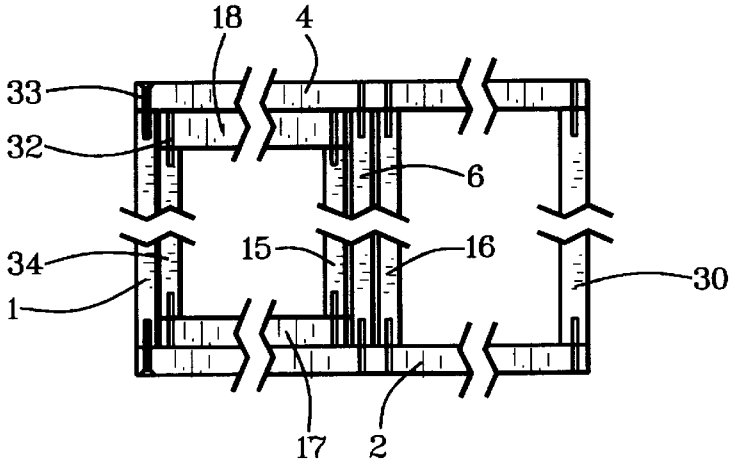
FIG. 5 is an expanded top view of corners of a poolside organizer having fastener orifices for being joined together with fasteners.

As depicted in FIG. 5, fastener orifices 32 can be pre-positioned for fasteners 33 proximate ends of the left upright 1, a left-upright support 34, the front bottom wall 2, the rear bottom wall 4, the front hanger wall 17, the rear hanger wall 18, the left receptacle wall 15, the right receptacle wall 16, the right upright 6 and the extension wall 30.

Referring to FIGS. 6–7, the angle brackets 13 employed for upright support can have length extended vertically along sides, edges and corners of the left upright 1, the right upright 6, the front bottom wall 2, the front hanger wall 17, the rear bottom wall 4, the rear hanger wall 18 and the extension wall 30 for an angle-bracket embodiment. The front hanger wall 17 can be positioned directly above the front bottom wall 2 and the rear hanger wall 18 can be positioned directly above the rear bottom wall 4 as illustrated with breakaway lines for this embodiment. The angle brackets 13 can be adhered with adhesive or bolted to adjoining walls.

Referring to FIGS. 8–12, the overlap brackets 14 employed for upright support also can have length extended vertically proximate sides of the left upright 1, the right upright 6, the front bottom wall 2, the front hanger wall 17, the rear bottom wall 4, the rear hanger wall 18 and the extension wall 30 for an overlap-bracket embodiment. As for the angle-bracket embodiment described in relation to FIGS. 6–7, the front hanger wall 17 can be positioned directly above the front bottom wall 2 and the rear hanger wall 18 can be positioned directly above the rear bottom wall 4 as illustrated with breakaway lines for this embodiment. The overlap brackets 14 also can be adhered with adhesive or bolted to adjoining walls.

A new and useful poolside organizer having been described, all such foreseeable modifications, adaptations, substitutions of equivalents, mathematical possibilities of combinations of parts, pluralities of parts, applications and forms thereof as described by the following claims and not precluded by prior art are included in this invention.

What is claimed is:

1. A poolside organizer comprising:

a front bottom wall;

a rear bottom wall;

a left upright having a bottom end that is joined to the front bottom wall proximate a left-front upright joint and that is joined to the rear bottom wall proximate a left-rear upright joint;

a right upright having a bottom end that is joined to the front bottom wall proximate a right-front upright joint and that is joined to the rear bottom wall proximate a right-rear upright joint;

the left upright having a top end with a left hanger wall;

the right upright having a top end with a right hanger wall;

the front bottom wall, the rear bottom wall, the bottom end of the left upright and the bottom end of the right upright being a base enclosure having a length, a width and a breadth to enclose bottom ends of a predetermined volume of elongate poolside items in variously upright orientations;

at least one upright support on the base enclosure having upright support of the left upright and the right upright;

a front hanger wall having a left end that is joined to a top of the left upright and having a right end that is joined to a top of the right upright;

a rear hanger wall having a left end that is joined to a top of the left upright and having a right end that is joined to a top of the right upright;

the front hanger wall and the left hanger wall having a front-left hanger joint;

the front hanger wall and the right hanger wall having a front-right hanger joint;

the rear hanger wall and the left hanger wall having a rear-left hanger joint;

the rear hanger wall and the right hanger wall having a rear-right hanger joint;

the front hanger wall, the rear hanger wall, a top of the left upright and a top of the right upright being a top enclosure;

a plurality of predetermined poolside hangers positioned on the front hanger wall, the rear hanger wall, the left hanger wall and the right hanger wall selectively;

at least one poolside tray positioned on the front hanger wall, the rear hanger wall, the left hanger wall or the right hanger wall selectively; and at least one bottom-end enclosure for arresting lateral travel of a bottom end of at least one elongate poolside item positioned uprightly within the top enclosure.

2. A poolside organizer as described in claim 1 and further comprising:

at least one extension enclosure extended horizontally from at least one bottom wall of the base enclosure; and the extension enclosure being sized and shaped to contain poolside items such as poolside toys, poolside items that are not easily hangable on the poolside hangers and optionally baskets for containing same.

3. A poolside organizer as described in claim 1 wherein:

the upright support on the base of the base enclosure is at least one upright receptacle into which at least either the bottom end of the right upright or the bottom end of the left upright are positioned.

4. A poolside organizer as described in claim 1 wherein:

the upright support on the base of the base enclosure is at least one angle bracket with which at least the bottom end of the right upright or the bottom end of the left upright are bracketed to the base enclosure.

5. A poolside organizer as described in claim 1 wherein:

the upright support on the base of the base enclosure is at least one overlap bracket with which at least the bottom end of the right upright or the bottom end of the left upright are bracketed to the base enclosure.

6. A poolside organizer as described in claim 1 wherein:

the front hanger wall is joined to the left hanger wall, the front hanger wall is joined to the right hanger wall, the rear hanger wall is joined to the left hanger wall and the rear hanger wall is joined to the right hanger wall selectively with angle brackets.

7. A poolside organizer as described in claim 1 wherein:

the front hanger wall is joined to the left hanger wall, the front hanger wall is joined to the right hanger wall, the rear hanger wall is joined to the left hanger wall and the rear hanger wall is joined to the right hanger wall selectively with overlap brackets.

8. A poolside organizer as described in claim 1 wherein:

the bottom-end enclosure is a plurality of linear slots having linear walls that are positioned apart to receive bottoms of uprightly positioned elongate poolside items.

9. A poolside organizer as described in claim 8 wherein:

the linear slots are juxtaposed intermediate the front bottom wall and the rear bottom wall; and the linear walls of the linear slots are extended intermediate the bottom ends of the left upright and the right upright.

10. A poolside organizer as described in claim 1 wherein:

heights of the front bottom wall and the rear bottom wall are approximately three-to-six inches;

tops of the front hanger wall, the rear hanger wall, the left upright and the right upright are approximately three-to-five feet vertically above the base enclosure;

the length of the base enclosure is approximately four-to-eight feet; and the width of the base enclosure is approximately three-to-six feet.

11. A poolside organizer as described in claim 2 wherein:

the extension enclosure is extended horizontally for a distance of approximately two-to-four feet from optionally the left upright or the right upright.

12. A poolside organizer as described in claim 1 wherein:

the predetermined poolside hangers positioned on the left hanger wall are two tube hangers having lateral extensions of approximately ten-to-twelve inches.

13. A poolside organizer as described in claim 1 wherein:

the predetermined poolside hangers positioned on the front hanger wall and on the right hanger wall are preferably towel, swimming-suit, goggle, fin and other swimming-attire hangers having lateral extensions of approximately three-to-six inches.

14. A poolside organizer as described in claim 1 wherein:

the predetermined poolside hangers optionally are not positioned on the rear hanger wall in order for optionally one side of the poolside organizer without obstruction by hangers to be positioned adjacent a structure such as a swimming-pool fence or building.

15. A poolside organizer as described in claim 1 wherein:

the poolside tray is sized and shaped to contain a predetermined quantity of such things as lotion receptacles, hair-care items, eye-care items and other body-care items.

16. A poolside organizer as described in claim 15 wherein:

the poolside tray has a bottom portion with at least one drain orifice.

17. A poolside organizer comprising:

a base enclosure having a length, a width and a breadth to enclose a predetermined volume of poolside items in desired standing, hanging and laying modes, a left upright and a right upright extended upwardly from the base enclosure;

an upright support on the base enclosure having upright support of the left upright and the right upright;

a front hanger wall having a left end that is joined to a top of the left upright and having a right end that is joined to a top of the right upright;

a rear hanger wall having a left end that is joined to a top of the left upright and having a right end that is joined to a top of the right upright;

the front hanger wall, the rear hanger wall, a top of the left upright and a top of the right upright being a top enclosure;

a plurality of predetermined poolside hangers positioned on the front hanger wall, the rear hanger wall, the left hanger wall and the right hanger wall selectively;

at least one poolside tray positioned on the front hanger wall, the rear hanger wall, the left hanger wall or the right hanger wall selectively;

at least one bottom-end enclosure for arresting lateral travel of a bottom end of at least one elongate poolside item positioned uprightly within the top enclosure;

at least one extension enclosure extended horizontally from at least one bottom wall of the base enclosure; and the extension enclosure being sized and shaped to contain poolside items such as poolside toys, poolside items that are not easily hangable on the poolside hangers and optionally baskets for containing same.

18. A poolside organizer as described in claim 17 wherein:

the upright support on the base enclosure is at least one upright receptacle into which at least either the bottom end of the right upright or the bottom end of the left upright are positioned.

19. A poolside organizer as described in claim 17 wherein:

the upright support is a plurality of fastener members with which the left upright and the right upright are fastened to the front bottom wall and to the rear bottom wall.

20. A poolside organizer as described in claim 17 wherein:

the upright support is at least one fastener bracket with which the left upright and the right upright are bracketed to the front bottom wall and to the rear bottom wall.

21. A poolside organizer as described in claim 20 wherein:

the fastener bracket is at least one angle bracket with which at least the bottom end of the right upright or the bottom end of the left upright are bracketed to the base enclosure.

22. A poolside organizer as described in claim 20 wherein:

the fastener bracket is at least one overlap bracket with which at least the bottom end of the right upright or the bottom end of the left upright are bracketed to the base enclosure.

* * * * *